US008752296B2

(12) United States Patent
Samons et al.

(10) Patent No.: US 8,752,296 B2
(45) Date of Patent: Jun. 17, 2014

(54) UNITARY SAFETY SCAFFOLDING AND METHOD FOR ONE INDIVIDUAL TO INSTALL THE SAME

(76) Inventors: W. Floyd Samons, Scottsdale, AZ (US); Walter T Campbell, Glendale, AZ (US)

( * ) Notice: Subject to any disclaimer, the term of this patent is extended or adjusted under 35 U.S.C. 154(b) by 0 days.

(21) Appl. No.: 13/507,456

(22) Filed: Jun. 29, 2012

(65) Prior Publication Data

US 2013/0074308 A1 Mar. 28, 2013

Related U.S. Application Data

(63) Continuation-in-part of application No. 13/385,858, filed on Mar. 9, 2012.

(60) Provisional application No. 61/634,218, filed on Feb. 24, 2012.

(51) Int. Cl.
*B21D 47/00* (2006.01)

(52) U.S. Cl.
USPC ..... 29/897.32; 29/897.3; 248/243

(58) Field of Classification Search
USPC ..... 29/897.3; 182/82
See application file for complete search history.

(56) References Cited

U.S. PATENT DOCUMENTS

| | | | | |
|---|---|---|---|---|
| 2,121,704 | A * | 6/1938 | Leeworthy | 248/235 |
| 3,134,567 | A * | 5/1964 | Shoemaker | 248/243 |
| 4,029,173 | A * | 6/1977 | Wakabayashi | 182/150 |
| 4,909,350 | A * | 3/1990 | Jacobs | 182/82 |
| 6,003,630 | A * | 12/1999 | Whalen | 182/82 |
| 6,367,754 | B1 * | 4/2002 | Cinker | 248/228.1 |
| 6,983,824 | B1 * | 1/2006 | Dandurand | 182/82 |
| 7,434,661 | B1 * | 10/2008 | Storey | 182/100 |
| 7,753,334 | B2 * | 7/2010 | Schreiber | 248/351 |
| 2002/0003061 | A1 * | 1/2002 | Philippe | 182/82 |
| 2006/0243523 | A1 * | 11/2006 | Curtin | 182/82 |
| 2006/0243524 | A1 * | 11/2006 | Jarrell | 182/82 |
| 2011/0147122 | A1 * | 6/2011 | Canham et al. | 182/150 |

* cited by examiner

*Primary Examiner* — David Bryant
*Assistant Examiner* — Ruth G Hidalgo-Hernandez
(74) *Attorney, Agent, or Firm* — Tod R. Nissle, P.C.

(57) ABSTRACT

A scaffold assembly permits a single individual to install the assembly on an open stud wall. The assembly includes a horizontally oriented walkway supporting member, a vertically oriented rail support member, and a support unit extending from the walkway supporting member to the ground. An attachment assembly is connected to the walkway supporting member and includes a pair of rotatable members, one of which bears against the outer edges of a pair of adjacent studs and the other of which bears against the inner edges of the adjacent pair of studs in order to secure the scaffold assembly in place.

3 Claims, 10 Drawing Sheets

UNITARY SAFETY SCAFFOLDING AND METHOD FOR ONE INDIVIDUAL TO INSTALL THE SAME

This application is a continuation-in-part of and claims priority based on application Ser. No. 13/385,858, filed Mar. 9, 2012, which claims priority based on application Ser. No. 61/634,218, filed Feb. 24, 2012.

This invention relates to scaffolding.

More particularly, the invention relates to a scaffold support assembly which can be installed by a single individual.

A long existing motivation in connection with scaffolding is to provide improved scaffolding systems.

Accordingly, it would be highly desirable to provide an improved scaffolding system.

Therefore it is a principal object of the invention to provide an improved scaffolding system and method for installing the same.

This and other, further and more specific objects of the invention will be apparent to those skilled in the art from the following detailed description thereof, taken in conjunction with the drawings, in which.

Figure 1:
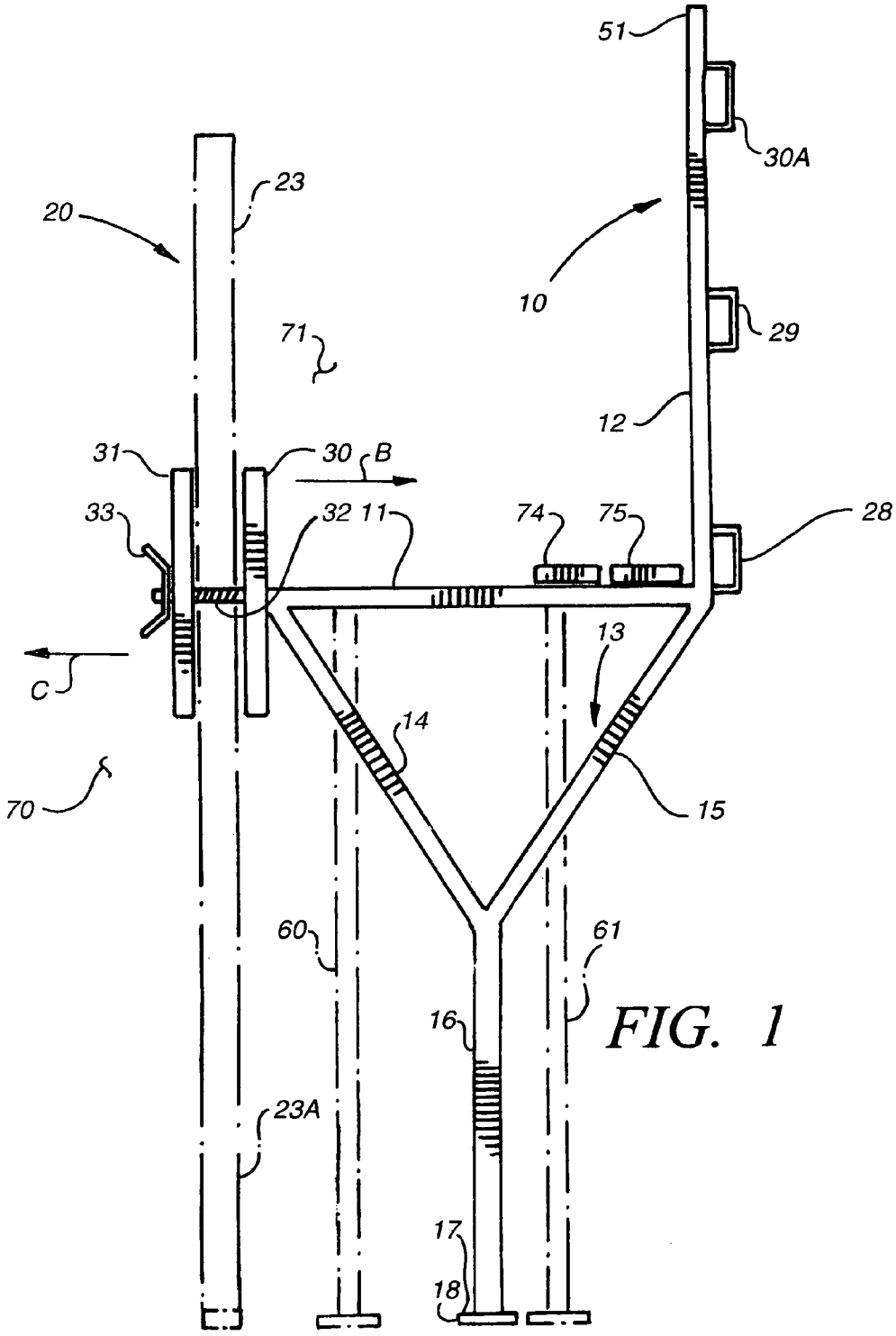
FIG. 1 is a side elevation view illustrating a scaffold support assembly constructed in accordance with the principles of the invention and illustrating the mode of operation thereof.

Briefly, in accordance with the invention, I provide an improved method for a single individual to install a scaffold support assembly on an open stud wall. The open stud wall includes an inner side; an outer side; a plurality of vertically oriented studs each spaced apart a selected distance, and, a horizontally oriented plate extending between the studs. The improved method includes the step of providing a unitary scaffold assembly. The unitary scaffold assembly includes a first horizontally oriented elongate platform support member having a proximate end and a distal end; a second vertically oriented elongate rail supporting member having an upper end and a lower end connected to the distal end of the first member; an elongate ground engaging support unit connected to the first member, having a foot, and shaped and dimensioned to extend from the first member to the ground such that the foot contacts the ground; a third member extending outwardly from the proximate end of the first member and a distance sufficient to span from the outer side of the stud wall to and past the inner side of the stud wall; a fourth member adjustably mounted on the third member to be moved along the third member toward and away from the first member to a plurality of positions along the third member; a fifth member rotatably mounted on the third member between the fourth member and the first member and having a length greater than the selected distance; and, a sixth elongate member between the fifth member and the first member, rotatably mounted on the third member, and having a length greater than the selected distance. The fifth and sixth members are each movable between at least two operative positions, a first operative position generally coplanar with the first, second, and third members, and, a second operative position generally perpendicular to the first, second, and third members. The first, second, third, fifth and sixth members, along with the support unit, generally collectively lie in a common plane when the fifth and sixth members are in the first operative position. The method also includes the steps of positioning the scaffold assembly on the inner side of the stud wall with the fifth and sixth members in the first operative position; moving the scaffold assembly between a selected adjacent pair of studs toward the outer side of the stud wall, each of the selected adjacent pair of studs having an outer edge on the outer side of the stud wall and having an inner edge on the inner side of the stud wall; placing the bottom end of the support unit on the ground such that the sixth member is located on the outer side of the stud wall and the fifth member is located on the inner side of the stud wall; rotating the sixth member to the second operative position on the outer side of the wall; rotating the fifth member to the second operative position on the inner side of the wall; and, moving the fourth member along the third member to press the sixth member against the outer edges of the selected adjacent pair of studs, and the fifth member against the inner edges of the selected adjacent pair of studs.

In another embodiment of the invention, I provide an improved method for a single individual to install a scaffold support assembly on an open stud wall. The wall includes an inner side; an outer side; a plurality of vertically oriented studs each spaced apart a selected distance from an adjacent one of the studs and having an upper end, an outer edge on the outer side of the wall, and an inner edge on the inner side of the wall; and, a horizontally oriented plate extending between the upper ends of the studs and having an inside edge on the inner side of the wall and an outside edge on the outer side of the wall. The improved method comprises the step of providing a unitary scaffold assembly. The scaffold assembly includes a first horizontally oriented elongate platform support member having a proximate end and a distal end; a second vertically oriented elongate rail supporting member having an upper end and a lower end connected to the distal end of the first member; a third vertically oriented elongate support member unit connected to the proximate end of the first member and extending upwardly and downwardly from the first support member, the third member including an upper end and a lower end; a fourth member connected to and extending outwardly from the upper end of the third member and shaped and dimensioned to slip from the inner side of the wall over the horizontally oriented plate; and, a fifth member rotatably mounted on the lower end of the third member below the first member and having a length greater than the selected distance. The fifth member is movable between at least two operative positions, a first operative position generally coplanar with the first, second, third, and fourth members; and, a second operative position generally perpendicular to the first, second, third, and fourth members. The first, second, third, fourth and fifth members generally collectively lie in a common plane when the fifth member is in the first operative position. The method also includes the steps of positioning the scaffold assembly on the inner side of the stud wall with the fifth member in the first operative position; moving the scaffold assembly between a selected adjacent pair of studs toward the outer side of the stud wall; positioning the scaffold assembly such that the fourth member engages and slides from the inner side of the stud wall over the horizontally oriented plate, the fourth member extending over the inside edge of the horizontally oriented plate; and, rotating the fifth member to the second operative position on the outer side of the wall and contacting the outside edges of the selected adjacent pair of studs.

Figure 2:
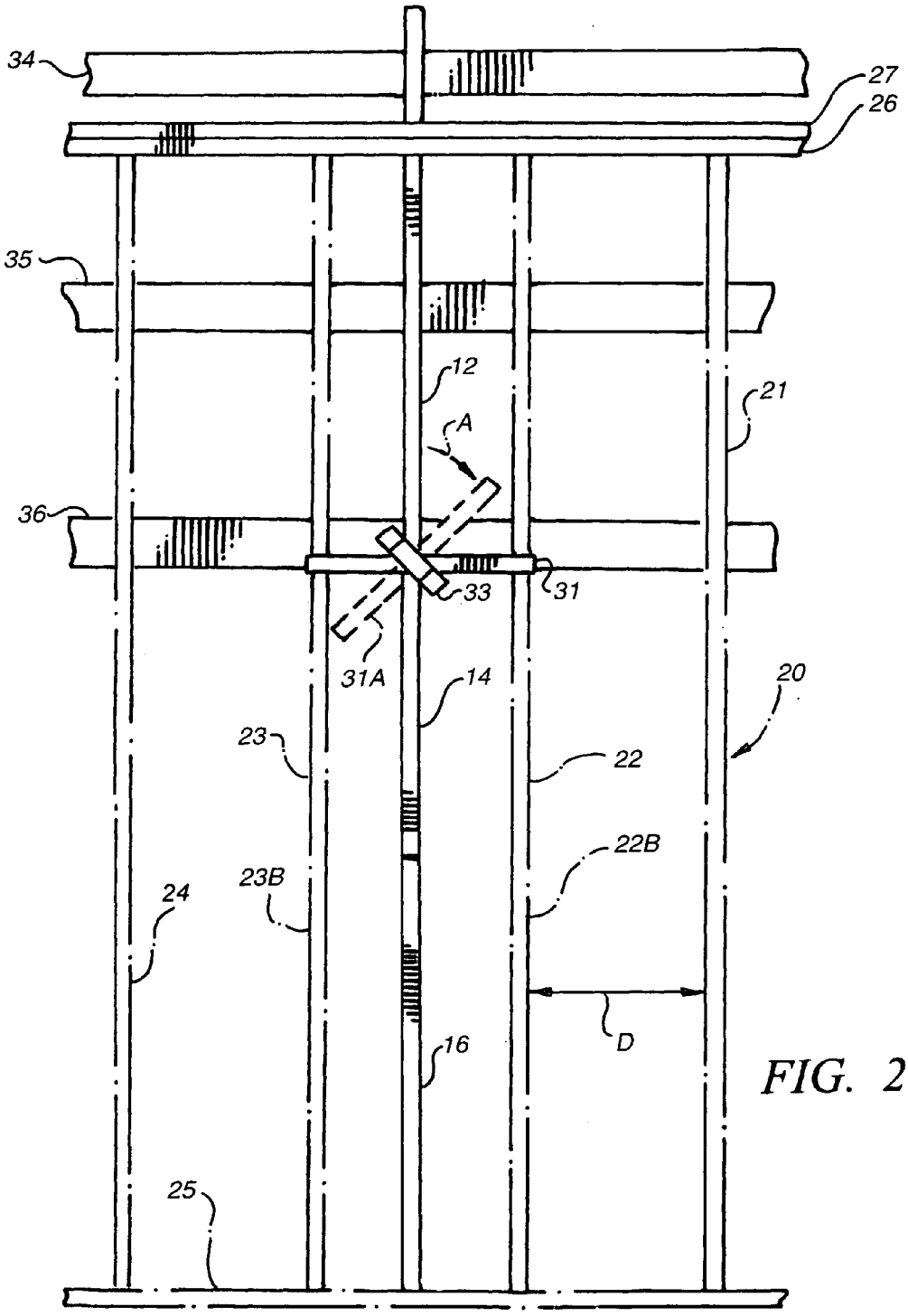
FIG. 2 is a front elevation view further illustrating the scaffold support assembly of FIG. 1 installed in an open stud wall.

Turning now to the drawings, which depict the presently preferred embodiments of the invention for the purpose of illustration thereof, and not by way of limitation of the invention, and in which like characters refer to corresponding elements throughout the several views, FIGS. 1 and 2 illustrate a unitary scaffold assembly 10 and method for installing the same in accordance with the invention. The open stud wall 20 includes an inner side 70, an outer side 71, a plurality of vertically oriented studs 21, 22, 23, 24 each spaced apart a selected distance D from an adjacent stud, and a horizontally oriented plate 25 extending between the studs. The unitary scaffold assembly includes a first horizontally oriented elongate platform support member 11 having a proximate end and a distal end; a second vertically oriented elongate rail supporting member 12 having an upper end 51 and a lower end connected to the distal end of the first member 11; and, an elongate ground engaging support unit 13 connected to the first member 11. The ground engaging unit includes members 14, 15, 16 and foot 17. The shape and dimension of foot 17 can vary as desired. Foot 17 is, as depicted in FIG. 1 located at the bottom of member 16. Horizontally oriented members 36, 37 extend along the top of studs 21 to 24. The height of the open stud wall is typically about eight feet or about nine feet, although such height can vary as desired.

As would be appreciated by those of skill in the art, at least two spaced apart unitary scaffold assemblies 10 are installed along an open stud wall so that a plurality of horizontally oriented walkway boards 74, 75 can be installed on the assemblies 10 and span or extend from support member 11 of one assembly 10 to the support member 11 of the other spaced apart assembly 10. Similarly, a horizontally oriented board or other railing 34 can be slidably installed through the bracket 30A of one assembly 10 and span or extend from that bracket 30A to and through the bracket 30A of the other assembly 10. A horizontally oriented board or other railing 35 can be slidably installed through the bracket 29 of one assembly 10 and span or extend from that bracket 29 to and through the bracket 29 of the other assembly 10. And, a horizontally oriented board or other railing 36 can be slidably installed through the bracket 28 of one assembly 10 and span or extend from that bracket 28 to and through the bracket 28 of the other assembly 10. FIG. 2 illustrates such railings 34 to 36 installed, although only a single assembly 10 is visible in FIG. 2.

The ground engaging unit 13 can be constructed in any desired manner as long as it spans the distance between member 11 and the ground 18 and sufficiently supports members 11 and 12, any walk way boards 74 and 75, and any railings 34, 35, 36 extending through U-shaped brackets 28, 29, 30A fixedly secured to member 12. The construction of unit 13 illustrated in FIG. 1 is one preferred embodiment of unit 13, in part because it tends to balance the weight of assembly 10. In an alternate embodiment of unit 13, members 14, 15, 16 are eliminated and are replaced by members 60 and 61, each of which extends to the ground and includes a foot. In another embodiment of unit 13, members 14, 15, 16 are eliminated and only member 61 is utilized. In a further embodiment of unit 13, members 14 and 15 are utilized in the manner illustrated in FIGS. 1 and 3, but member 16 is eliminated and replaced by members 62 and 63 (FIG. 3), wherein members 62 and 63 each include a ground contacting foot. In still another embodiment of the invention, members 14 and 15 are utilized in the manner illustrated in FIGS. 1 and 3, but member 16 is eliminated and replaced only with member 62, wherein member 62 includes a ground contacting foot. The point at which a foot 17 contacts the ground can vary as desired. In many applications of the assembly 10, a foot 17 contacts the ground at a point spaced outwardly apart from the periphery of a foundation on which an open stud wall 20 is constructed. In other applications of the assembly 10, a foot 17 may contact the ground at a point on the foundation or floor on which wall 20 is constructed. For example, an assembly 10 can be utilized to erect scaffolding along an open stud wall that is located on the interior of the foundation. Consequently, as used herein, the term ground encompasses ground or earth outside the periphery of the foundation of a building, encompasses the foundation, or floor, on which an open stud wall is constructed, and encompasses a ground or foundation based structure, for example a sidewalk, on which a foot 17 can rest. The foundation for an open stud wall can comprise a concrete slab, which is typically the case on the ground floor of a building structure, particularly a residential structure. The foundation of the second, third, fourth, etc. stories in a commercial building can also comprise a floor consisting of a concrete slab. On the other hand, the foundation of a ground floor or of a second, third, fourth, etc. story floor can also comprise horizontally oriented spaced apart wood beams, for example two by twelve wood beams, covered by plywood sheets fastened to the wood beams. Another foundation construction comprises horizontally oriented spaced apart metal beams covered with plywood or some other flooring material. Regardless of the materials utilized to construct a foundation, the foundation serves the function of providing a base or support for an open stud wall.

Foot 17 can simply comprise the bottom of a member 16. A member 14, 15, 16, 60 to 63 can telescope or otherwise be adjustable so the length of the member can be adjusted as desired.

Assembly 10 includes a third externally threaded member 32 extending outwardly from the proximate end of the first member and a distance sufficient to span from the outer side of the stud wall to and past the inner side of the stud wall; includes a fourth internally threaded member 33 adjustably mounted on the third member 32 to be moved along the third member 32 toward and away from the first member 11 to a plurality of positions along the third member; includes a fifth member 31 rotatably mounted on the third member 32 between the fourth member 33 and the first member 11 and having a length greater than the selected distance between an adjacent pair of studs; and, includes a sixth elongate member 30 between said fifth member 31 and the first member 11, rotatably mounted on the third member 32, and having a length greater than the selected distance between an adjacent pair of studs. Member 11 functions as a stop for sixth member 30 and in FIG. 1 prevents member 30 from moving any further in the direction of arrow B. On the other hand, in FIG. 1 vertically oriented member 30 can slide in the direction of arrow C until it contacts vertically oriented member 31. Note that in FIG. 1 there is not a stud 20 to 24 positioned between members 30 and 31. Also, in FIG. 1 vertically oriented member 31 can be slid along member 32 in the direction of arrow B until member 31 contacts vertically oriented member 30.

The fifth 31 and sixth 30 members are each movable between at least two operative positions, a first vertically oriented operative position generally coplanar with said first 11, second 12, and third 32 members, and a second horizontally oriented operative position generally perpendicular to the first 11, second 12, and third 32 members. FIG. 1 illustrates members 30 and 31 in the first operative position. FIG. 2 illustrates members 30 and 31 in the second operative position. In the first operative position, members 30 and 31 may be somewhat canted from the vertical, but must be sufficiently vertical to fit through the space, indicating by arrows D in FIG. 2, between an adjacent pair 22-23 of vertically oriented studs. Although the distance between each adjacent pair of studs can vary, the distance D (FIG. 2) between a first adjacent pair 21-22 of studs is typically equal to the distance between other adjacent pairs 22-23, 23-24 of studs in an open stud wall. As is illustrated in FIG. 2, the length of each member 30 and 31 is greater than distance D, this so that when members 30 and 31 are in the second operative position, the ends of members 30 and 31 bear against the outer and inner edges, respectively, of studs 22 and 23.

The first 11, second 12, third 32, fifth 31 and sixth 30 members, along with the support unit 13, generally collectively lie in a common plane when said fifth 31 and sixth 30 members are in the first operative position. Members 11, 12, 14, 15, 16, 30, 31 preferably each comprise a length of tubular steel or other material such that the cross-sectional shape and dimension of each of said members 11, 12, 14, 15, 16, 30, 31 is equivalent. When the cross-sectional shape and dimension of each of said members 11, 12, 14, 15, 16, 30, 31 is the same and members 30 and 31 and 33 are in the vertical orientation illustrated in FIG. 1, multiple assemblies 10 are readily stacked one on top of the other and take up a minimal amount of storage space, which is one of the virtues of the assemblies 10 of the invention. Each assembly 10 does not include walk way boards 74 and 75 or include railings 34 to 36. The walk way boards 74 and 75 and railings 34 to 36 are installed after assemblies 10 are installed in an open stud wall.

In use, an individual carries an assembly 10 to the inner side 70 of an open stud wall 20. The individual holds assembly 10 in an upright orientation generally equivalent to that shown in FIGS. 1 and 2. The individual insures that members 30 and 31 are the first operative position, i.e., are generally vertically oriented in the manner illustrated in FIG. 1 so that members 31 and 30 will fit in the space between an adjacent pair of studs 22 and 23. The individual lifts assembly 10 and moves it between studs 22 and 23 to a position equivalent to that illustrated in FIG. 1 with foot 17 of member 16 contacting the ground 18. The individual then rotates members 31 and 30 in the direction of arrow A (FIG. 2) to a horizontally oriented position such that member 30 is adjacent the outer edges 23A of studs 22 and 23 and member 31 is adjacent the inner edges 22B, 23B of studs 22 and 23 in the manner illustrated in FIG. 2. Internally threaded member 33 is turned along externally threaded member 32 to move member 33 in the direction of arrow B and compress member 31 against inner edges 22B, 23B and member 30 against outer edges 23A. Turning member 33 to move it in the direction of arrow B forces and tightens member 33 against member 31, which in turn compresses studs 22 and 23 intermediate members 31 and 30. Members 31 and 30 have apertures formed therethrough which permit members 31 and 30 to slide along (and rotate about) member 32. While in the current embodiment of the invention, member 32 is externally threaded and member 33 is internally threaded, other constructs can be utilized to permit the position of member 33 along member 32 to be adjusted. For example, member 33 can include a set screw which is tightened after member 33 is pressed against member 31 to compress studs 22 and 23 between the ends of members 31 and 30. Or, members 33 and 32 can be shaped and dimensioned to function as a bayonet mount. Or member 32 can include teeth and member 33 can include a locking ratchet head in the manner of a cable strap, except that the locking ratchet head can be disengaged from the teeth. And so on. Once members 31 and 30 are in the second operative position illustrated in FIG. 2, they can, if desired, be screwed to studs 22 and 23 to further detachably secure members 31 and 30 in place. Similarly, foot 17 can be screwed or otherwise detachably fastened to the ground to help maintain it in place.

After an individual (or more than one individual, if desired) installs two or more spaced apart assemblies 10 along an open stud wall, the individual installs the rail(s) 34 to 36 and the walkway board(s) 74 and 75 to extend from one assembly 10 to the other assembly 10.

Figure 3:
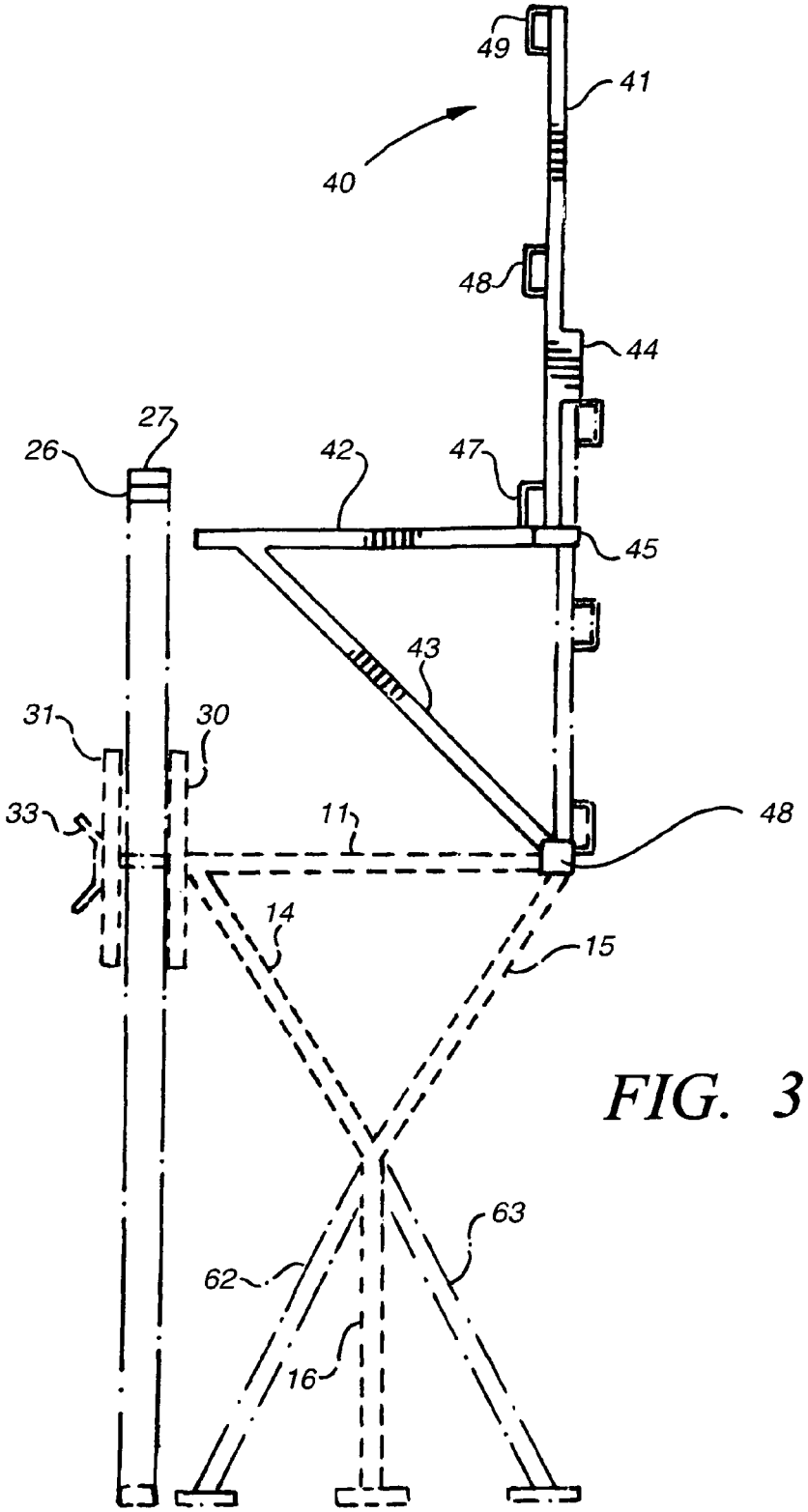
FIG. 3 is a side elevation view illustrating a supplemental scaffold support assembly utilized in conjunction with the scaffold support assembly of FIGS. 1 and 2.
Figure 4:
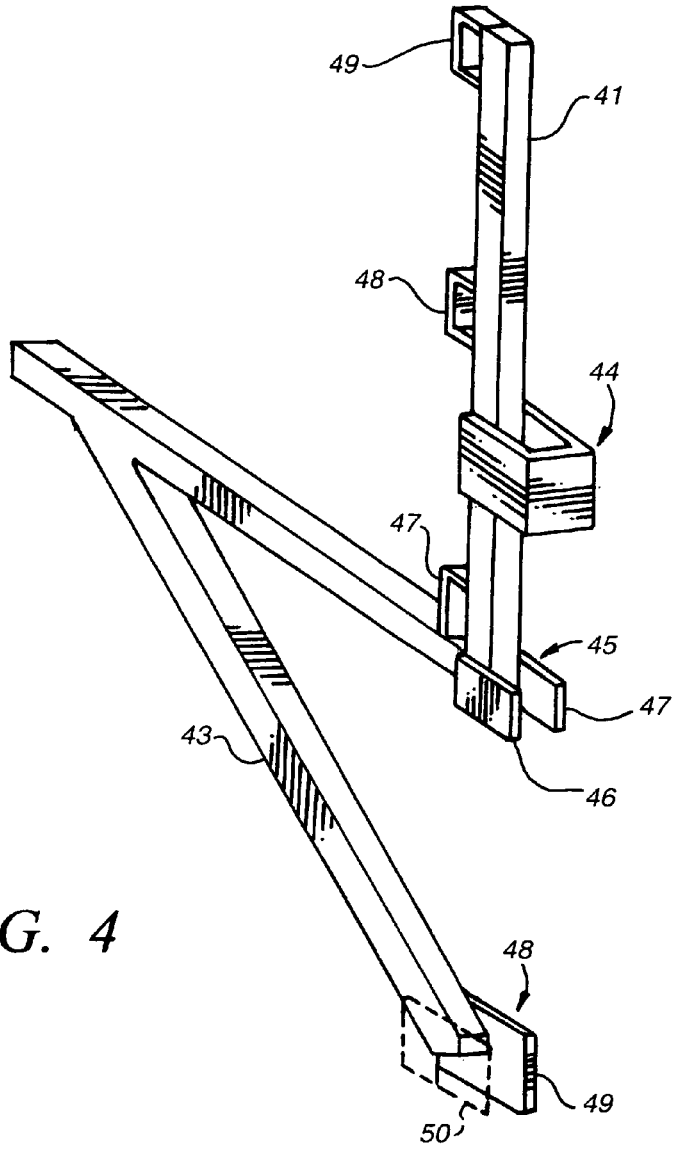
FIG. 4 is a perspective view further illustrating the supplemental scaffold support assembly of FIG. 3.

FIGS. 3 and 4 illustrate a supplemental scaffold assembly 40 that is, if desired, utilized in conjunction with an assembly 10. Assembly 40 includes horizontally oriented platform support member 42, vertically oriented rail support member 41, and support member 43. The lower end of member 41 is fixedly secured to the outer, or distal, end of member 42. The upper end of member 43 is fixedly secured to the inner, or proximate, end of member 42. Sleeves 47, 48, 49 are fixedly secured to the inner side of member 41. Sleeve 44 is fixedly secured to the outer side of member 41. Sleeve 44 is shaped and dimensioned to slide, when assembly 40 is mounted on assembly 10, over and engage the upper end 51 of member 12 (FIG. 1). A pair 45 of plates or fingers 46, 47 (FIG. 4) are fixedly secured to member 42 and are spaced apart to slide, when assembly 40 is mounted on assembly 10, over edges of member 12 in the manner illustrated in FIG. 3. A pair 48 of plates or fingers 49 and 50 (FIG. 4) are fixedly secured to member 43 and are spaced apart to slide, when assembly 40 is mounted on assembly 10, over the edges of members 11 and 12 at the juncture of members 11 and 12 in the manner illustrated in FIG. 3.

As noted, after an assembly 10 is installed on an open stud wall, assembly 40 is installed on assembly 10 by sliding sleeve 44 downwardly over upper end 51, by sliding fingers 46 and 47 over the slides of member 12, and by sliding fingers 49 and 50 over the juncture of members 11 and 12. FIG. 3 illustrates the installation of assembly 40 on assembly 10.

Once at least a pair of vertically oriented spaced apart assemblies 40 is installed on a pair of spaced apart vertically oriented assemblies 10, horizontally oriented walkway boards are placed on and extend between spaced apart members 42 of the pair of assemblies 40, and, horizontally oriented railings, comparable to railings 34 to 36, are slid through and extend between each pair of sleeves in the assemblies 40. One railing is slid through sleeves 49; another through sleeves 48; and, a third railing through sleeves 47.

Assembly 40 permits the height of scaffolding walkway boards to be increased to facilitate working on the roof of a building.

The cross section shape and dimension of each member 41, 42, 43 is preferably equivalent to facilitate stacking and storing a plurality of assemblies 40.

By way of example, and not limitation, the height of assembly 10, which height extends from the bottom of foot 17 to the top of member 12, is presently one hundred and nine inches; the height from the bottom of foot 17 to the top of bracket 30 is presently one hundred and three inches; and the height from the bottom of foot 17 to the upper surface of horizontally oriented member 11 is presently sixty-one inches. In FIG. 1, walkway boards 74 and 75 each lie on and contact the upper surface of member 11. The height of assembly 40 from the bottom of member 43 to the top of member 41 is presently seventy-eight inches. The height, or distance, from the bottom of member 43 to the upper surface of member 42 is presently thirty inches. Horizontally oriented walkway boards (not shown) lie on and contact the upper surface of member 42 in the same manner that boards 74 and 75 lie on and contact the upper surface of member 11.

Figure 5:
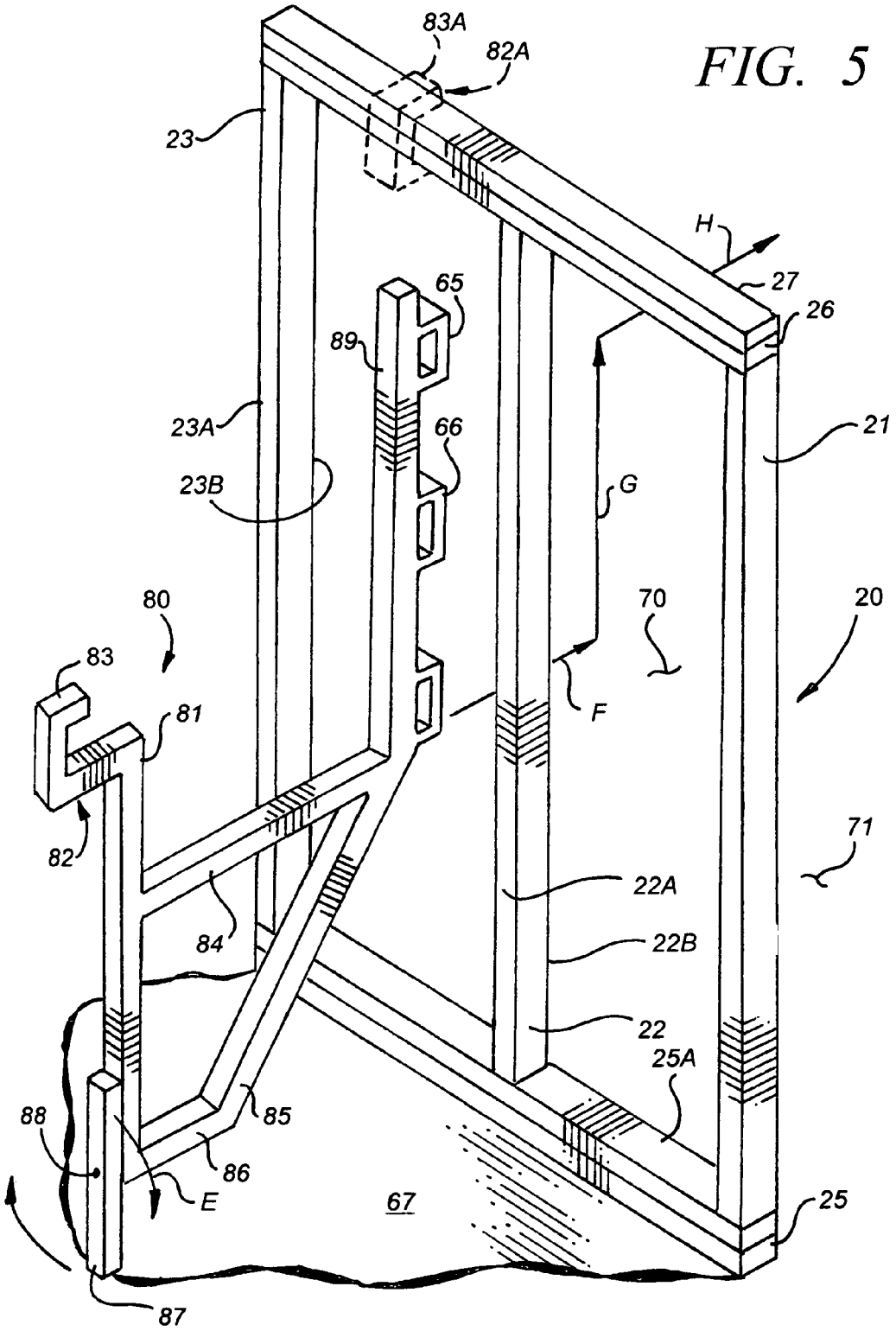
FIG. 5 is a perspective view illustrating an alternate embodiment of the invention and the mode of operation thereof during installation of the invention.
Figure 6:
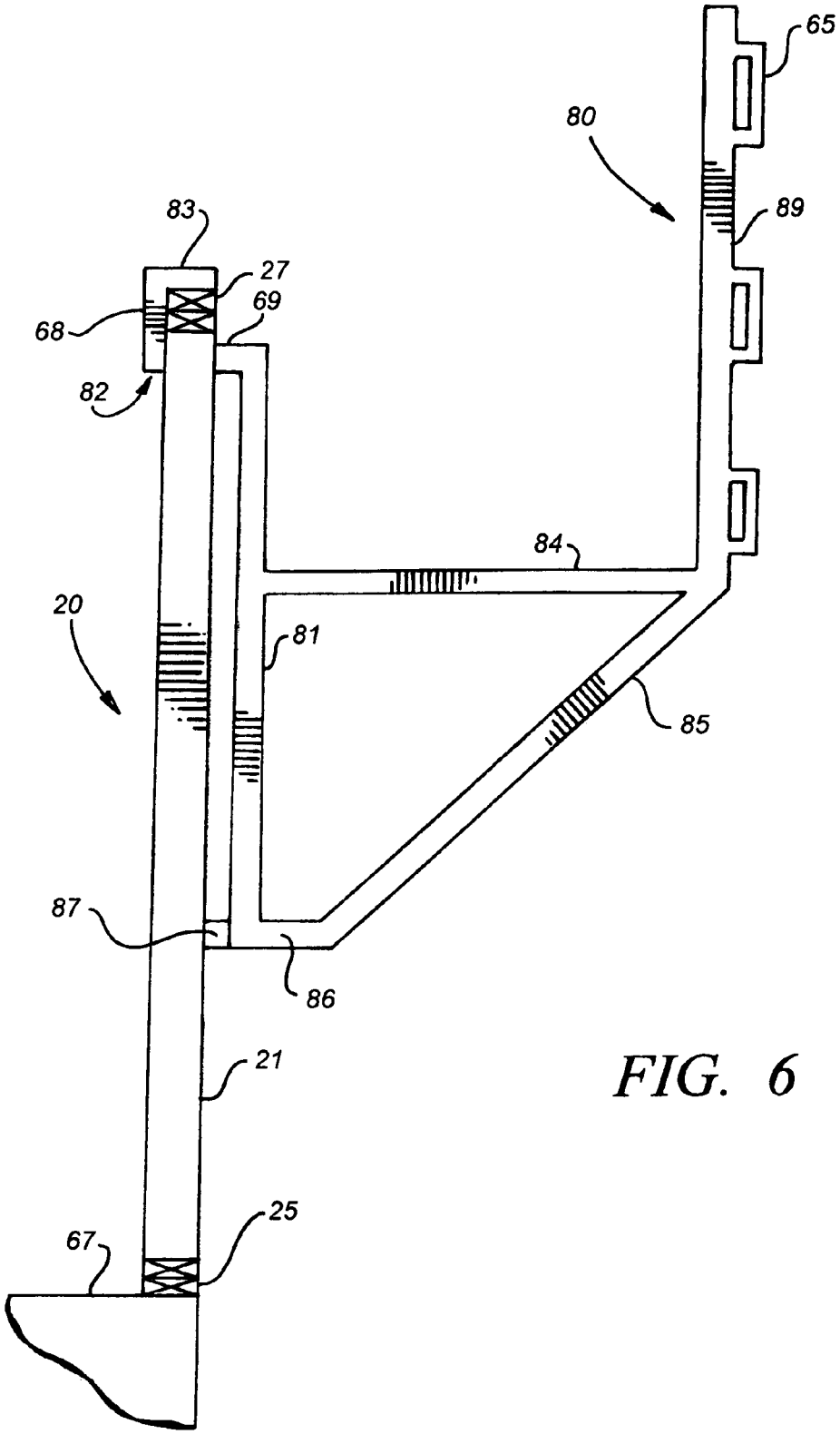
FIG. 6 is a side view illustrating the invention of FIG. 5 after it is installed on a frame wall in a building structure.
Figure 7:
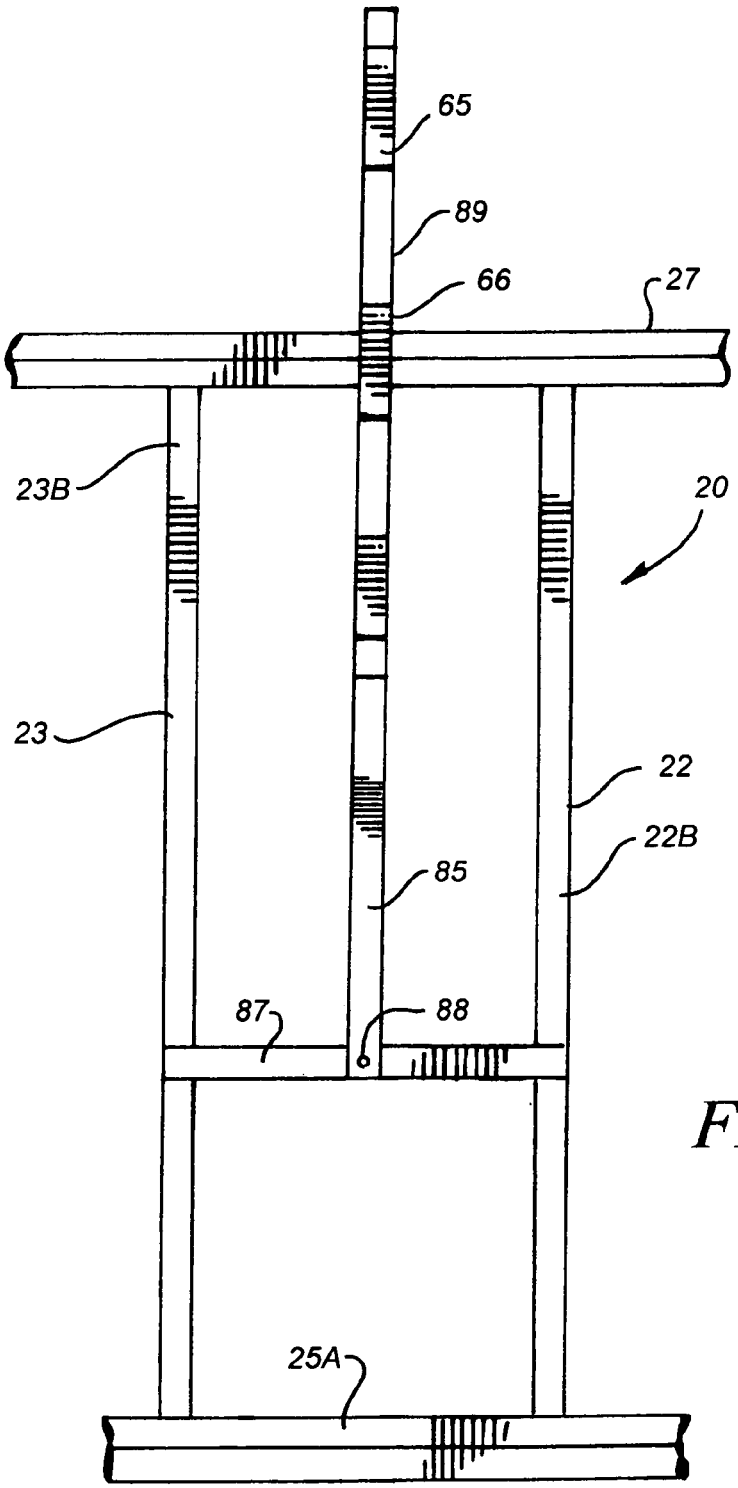
FIG. 7 is a front view illustrating the invention of FIG. 5 after it is installed on a frame wall in a building structure.

FIGS. 5 to 7 illustrate a scaffold assembly 80 constructed in accordance with an alternate embodiment of the invention. Assembly 80 can, like assembly 10, be installed by a single individual standing on the inner side 70 of an open stud wall 20. Wall 20 comprises an open stud wall because the space between adjacent stud pairs 22-23, 21-22 is open; insulation, sheet rock, and siding has not yet been installed in or on wall 20. Studs 22 and 23 each include an inside edge 22A, 23A, respectively, on the inner side 70 of wall 20 and each include an outside edge 22B, 23B, respectively, on the outer side 71 of wall 20. Wall 20 is secured to the floor 67 of a building structure. Outer side 71 ordinarily is on the exterior of the building structure. Wall 20 in FIGS. 5 to 7, in contrast to wall 20 in FIGS. 1 to 3, includes a bottom plate which includes a pair 25, 25A of two-by-fours. Otherwise, wall 20 in FIGS. 5 to 7 is equivalent to wall 20 in FIGS. 1 to 3.

Scaffold assembly 80 includes a first horizontally oriented elongate member 84 for supporting horizontally oriented planks (comparable to planks 74 and 75 in FIG. 1) that each extend between spaced apart pairs of scaffold assemblies 80 and comprise a walkway or platform on which construction personnel walk when they are over and between assemblies 80.

The outer end of the first horizontally oriented member 84 is connected to a second vertically oriented rail support member 89. Sleeves 65 and 66 are shaped and dimensioned such that horizontally oriented rails can slide through sleeves 65 and 66 on a first scaffold assembly 80 and extend from sleeves 65 and 66 in said first scaffold assembly 80 to sleeves 65 and 66 in a second equivalent scaffold assembly 80 that is spaced apart from the first scaffold assembly and that is generally at the same elevation about the ground as the first scaffold assembly. Sleeves 65 and 66 can be sized such that two or more rails or planks can be slidably inserted in each sleeve 65, 66.

The inner end of first member 84 is connected to a third vertically oriented member 81. Vertically oriented elongate third member 81 extends above and below member 84. The upper end of member 81 is connected to a fourth generally U-shaped member 82. Fourth member 82 includes upper generally horizontally oriented leg 83, lower generally horizontally oriented leg 69, and intermediate vertically oriented leg 68 extending between and interconnecting legs 83 and 69 (FIG. 6). Fourth member 82 is shaped and dimensioned such that member 82 slides over and engages horizontally oriented members 26 and 27 which comprise the upper plate of wall 20. When assembly 80 is mounted on wall 20 intermediate an adjacent pair of studs 22 and 23, the location of fourth member 82 is indicated by dashed lines 82A in FIG. 5; and, horizontally oriented leg 83 rests--as indicated by dashed lines 83A-on top of member 27 while horizontally oriented leg 69 extends beneath member 26.

The lower end of member 81 is connected to generally horizontally oriented member 86, while canted elongate member 85 interconnects members 86 and 84.

Elongate fifth member 87 is pivotally mounted on shaft 88 at the lower end of vertically oriented third member 81. The first operative position of fifth member 87 is illustrated in FIG. 5. In FIG. 5, member 87 is generally vertically oriented and coplanar with members 81, 82, 84, 85, 86, and 89.

The second operative position of member 87 is illustrated in FIGS. 6 and 7. In FIGS. 6 and 7, member 87 is generally horizontally oriented and perpendicular to members 81 to 86, 89. The length of member 87 is greater than the distance between studs 22 and 23 such that when member 87 is in the second operative position the outer ends of member 87 rest on the outside edges 22B and 23B of studs 22 and 23, respectively.

Member 87 is pivotally moved from the first operative position to the second operative position by rotating member 87 about shaft 88 in the manner indicated by arrows E in FIG. 5 through an arc of ninety degrees.

The outer end of horizontally oriented member 84 is connected to vertically oriented rail support member 89. Sleeves 65 and 66 are shaped and dimensioned such that horizontally oriented rails can slide through sleeves 65 and 66 on a first scaffold assembly 80 and extend from sleeves 65 and 66 in said first scaffold assembly 80 to sleeves 65 and 66 in a second equivalent scaffold assembly 80 that is spaced apart from the first scaffold assembly and that is generally at the same elevation above the ground as the first scaffold assembly. Sleeves 65 and 66 can be sized such that two or more rails or planks can be slidably inserted in each sleeve 65, 66.

In use of scaffold assembly 80, at least one individual carries assembly 80 and positions assembly 80 on the inner side 70 of an open stud wall 20. The individual moves assembly 80 substantially entirely between studs 22 and 23 in the direction indicated by arrow F; provided, however, member 82 remains on the inner side of wall 20. The individual then lifts assembly 80 upwardly in the direction of arrow G until the elevation of member 82 is substantially equivalent to that of horizontally oriented members 26 and 27, at which point the individual moves assembly 80 in the direction of arrow H until member 82 slides over and seats on the upper plate (which plate consist of members 26 and 27) in the manner indicated by dashed lines 82A in FIG. 5 and in the manner illustrated in FIG. 6. Member 87 is then rotated in the direction of arrows E (FIG. 5) from the first operative position of FIG. 5 to the second operative position of FIGS. 6 and 7 such that the outer ends of member 87 each rest against a different one of the outside edges 22B and 23B of studs 22 and 23 in the manner illustrated in FIGS. 6 and 7. If desired, nails or screws or other fastening means can be utilized to secured the outer ends of member 87 to studs 22 and 23 in FIG. 7. The foregoing process is repeated for other assemblies 80. Adjacent assemblies 80 are spaced apart a desired distance from each other. The desired distance typically is short enough so that planks 74, 75 can safely be used to extend from horizontal member 84 in one assembly 80 to the horizontal member 84 in at least one of the adjacent assemblies 80.

A further embodiment of the invention is illustrated in FIGS. 8 to 12. The scaffold assembly 90 is similar to assembly 80 except that assembly 90 is, as will be discussed, slidably extendable. The initial installation of assembly 90 is, however, comparable to the procedure described above in connection with assembly 80. Assembly 90 can, like assemblies 10 and 80, be installed by a single individual standing on the inner side 70 of an open stud wall 20. Assembly 90 is installed in an open stud wall 20 when assembly 90 is in the configuration illustrated in FIG. 8; consequently, after assembly 90 is installed, member 92 engages and rests on the top plate 26, 27 of wall 20 in the same manner that member 82 rests on the top plate of wall 20 in FIG. 7.

Scaffold assembly 90 includes a first horizontally oriented elongate member 94 for supporting horizontally oriented planks (comparable to planks 74 and 75 in FIG. 1) that each extend between adjacent spaced apart pairs of scaffold assemblies 80 and comprise a platform on which construction personnel walk when on assemblies 80.

The inner end of member 94 is connected to vertically oriented member 95. Vertically oriented elongate member 95 extends above member 94. The upper end of member 95 is connected to horizontally oriented member 96. Member 96 is connected to the upper end of vertically oriented member 120 (FIG. 9). Member 120 is slidably received by hollow vertically oriented member 91. Apertures 92A are formed in member 120 such that when apertures 92A are in registration with apertures 92 formed in member 91 a quick release pin 53 (FIG. 8) or other fastener can be inserted in an aperture pair 92-92A to fix member 120 in a desired position with respect to member 91.

Member 92 is secured to the upper end of member 91 by right angle member 76. Member 92 includes upper generally horizontally oriented leg 93, lower generally horizontally oriented leg 73, and intermediate vertically oriented leg 72 extending between and interconnecting legs 93 and 73. Member 92 is shaped and dimensioned such that member 92 slides over and engages horizontally oriented members 26 and 27 which comprise the upper plate of wall 20. When assembly 90 is mounted on wall 20 intermediate an adjacent pair of studs 22 and 23, the location of member 92 is comparable to that indicated for assembly 80 by dashed lines 82A in FIG. 5; and, horizontally oriented leg 93 rests on top of member 27 while horizontally oriented leg 73 extends beneath member 26.

One end of horizontally oriented member 52 includes an orthogonal opening 57 which is slidably mounted on member 91. Canted elongate member 99 interconnects members 52 and 94.

Elongate member 97 is pivotally mounted on fixed shaft 98 at the lower end of vertically oriented member 91. The operation of member 97 is comparable to that of member 87. Accordingly, member 97 moves between a first operative position and a second operative position. In the first operative position (not shown), member 97 is generally vertically oriented and is coplanar with members 91, 92, 93, 94, 95, 52, 99, and 54.

Figure 8:
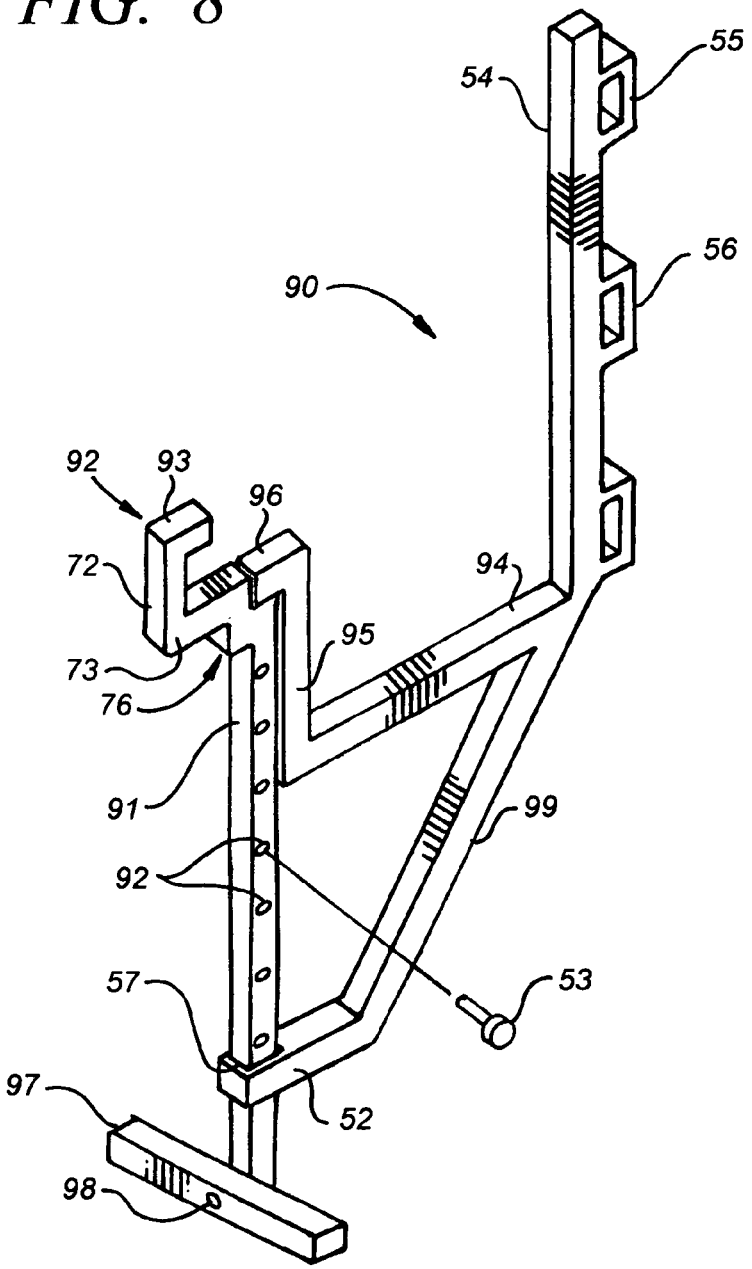
FIG. 8 is a perspective view illustrating a further embodiment of the invention comprising an extendable scaffold support structure.
Figure 9:
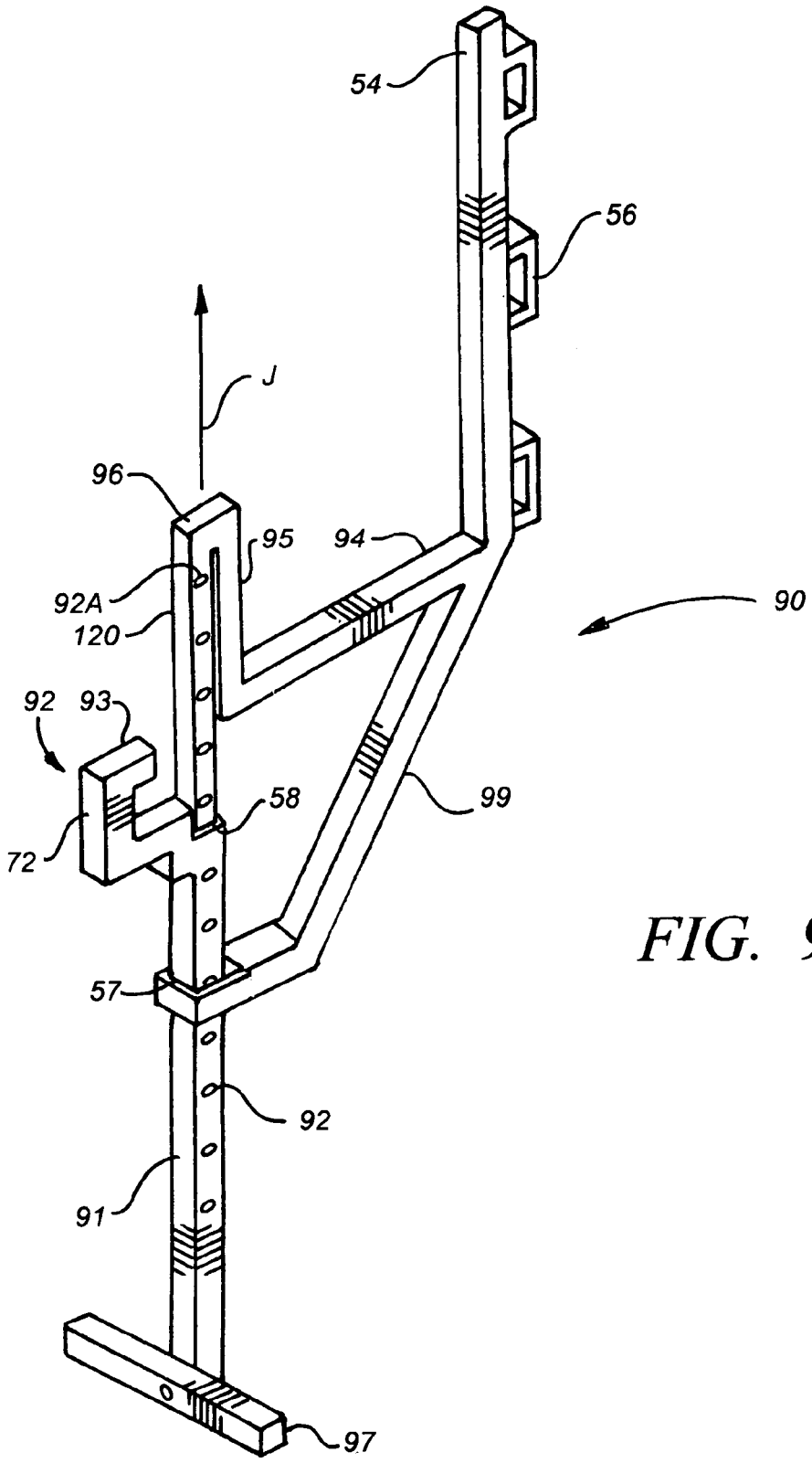
FIG. 9 is a perspective view further illustrating the extendable scaffold support structure of FIG. 8.
Figure 10:
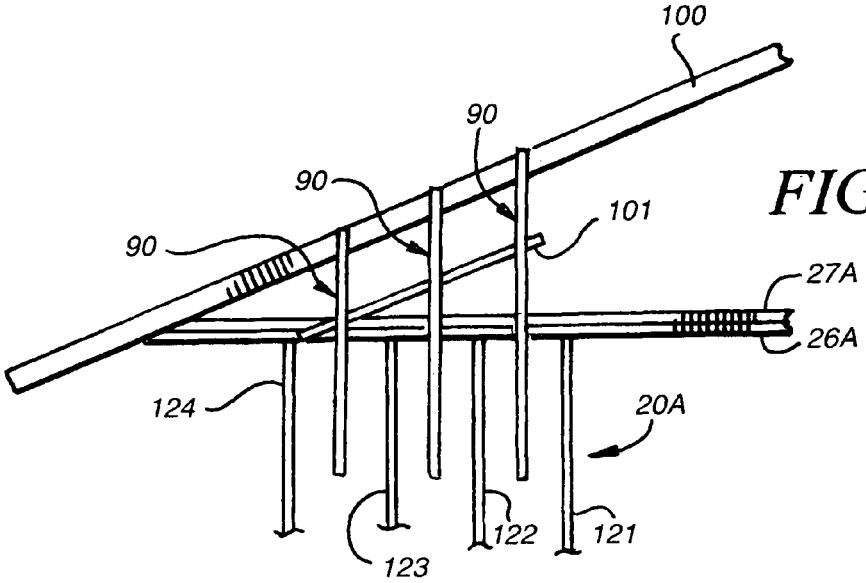
FIG. 10 is a side view of a residential structure illustrating the mode of operation of a plurality of extendable scaffold structures of FIG. 8 installed thereon.

The second operative position of member 97 is illustrated in FIGS. 8 and 9. In FIGS. 8 and 9, member 97 is generally horizontally oriented and is perpendicular to members 91, 93, 94, 95, 52, 99, and 54. The length of member 97 is greater than the distance between studs 22 and 23 such that when member 97 is in the second operative position the outer ends of member 97 rest on the outside edges 22B and 23B of studs 22 and 23.

Member 97 is pivotally moved between the first operative position and the second operative position by rotating member 97 about shaft 98 in the manner indicated by arrows E in FIG. 5 through an arc of ninety degrees.

The outer end of horizontally oriented member 94 is connected to vertically oriented rail support member 54. Sleeves 55 and 66 are shaped and dimensioned such that horizontally oriented rails can slide through sleeves 55 and 56 on a first scaffold assembly 90 and extend from sleeves 55 and 56 in said first scaffold assembly 90 to sleeves 55 and 56 in a second equivalent scaffold assembly 90 that is spaced apart from the first scaffold assembly in which members 91, 97, 76, and 92 are generally at the same elevation above the ground as are members 91, 97, 76, and 92 in the first scaffold assembly. Sleeves 55 and 56 can be sized such that two or more rails or planks can be slidably inserted in each sleeve 55, 56.

In use of scaffold assembly 90, at least one individual carries assembly 90 as configured in FIG. 8 and positions assembly 90 on the inner side 70 of an open stud wall 20. The individual moves assembly 90 substantially entirely between studs 22 and 23 in a direction comparable to that indicated by arrow F in FIG. 5; provided, however, member 92 remains on the inner side of wall 20. The individual then lifts assembly 90 upwardly in a direction comparable to that of arrow G in FIG. 5 until the elevation of member 92 is substantially equivalent to that of horizontally oriented members 26 and 27, at which point the individual moves assembly 90 in a direction comparable to that of arrow H in FIG. 5 until member 92 slidably seats on the upper plate (which plate consist of members 26 and 27) in a manner comparable to that indicated by dashed lines 82A in FIG. 5 and in FIG. 6. Member 97 is then rotated from the first operative position to the second operative position such that the outer ends of member 97 each rest against a different one of the outside edges 22B and 23B of studs 22 and 23 in a manner comparable to that illustrated in FIGS. 6 and 7. If desired, nails or screws or other fastening means can be utilized to secure the outer ends of member 97 to studs 22 and 23. The foregoing process is repeated for other assemblies 90. Adjacent assemblies 90 are spaced apart a desired distance. The desired distance typically is short enough so that planks 74, 75 can safely be used to extend from horizontal member 94 in one assembly 80 to the horizontal member 94 in at least one adjacent assembly 80.

One particular virtue of assemblies 90 is that they can be utilized to follow a roof line 100 (FIG. 10) that is canted with respect to the horizontally oriented top plate 26A, 27A of an open stud wall 20A (FIG. 10) which includes vertically oriented studs 121, 122, 123, 124. For example, as the roof line 100 angles upwardly (or downwardly) away from top plate 26A and 27A, then each sequential assembly 90 can be extended by removing quick release pin 53, slidably raising members 120, 96, 95, 94, 54, 99 and 52 (while members 91, 92, and 97 remain in fixed position) to a desired height and then reinserting pin 53 in a registered aperture pair 92A-92 in order to secure raised members 120, 96, 95, etc. in a desired elevated position. While the amount by which members 120, 96, 95, etc. in each assembly 90 are slidably raised or elevated can vary as desired, it is currently desired that each sequential assembly 90 raise its members 120, 96, 95, etc. an amount sufficient for planks 101, 108 placed on horizontally oriented members 94 to follow and be parallel to the roof line in the manner illustrated in FIG. 10.

Figure 11:
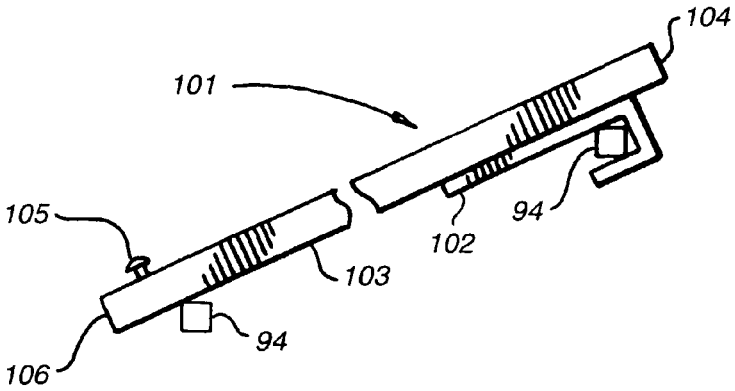
FIG. 11 is a side view illustrating a primary walking plank utilized in conjunction with the extendable scaffold support structures of FIGS. 8 to 10; and, FIG. 12 is a bottom view of a secondary walking plank utilized in conjunction with the extendable scaffold support structure of FIGS. 8 to 10 and configured to be removably attached to the primary walking plank of FIG. 11.
Figure 12:
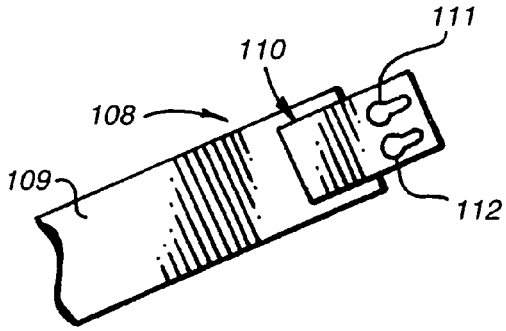

Planks 101, 108 or other walkway structures placed on members 94 can have any desired shape, dimension, and construction. One preferred construct of a walkway plank 101 is illustrated in FIG. 11 and includes a bracket 102 attached to the bottom of the upper end of plank 101. Bracket 102 is sized to fit over and engage a horizontally oriented member 94 of an assembly 90. The lower end of plank 101 is provided with a pair of upstanding, spaced apart rivet or screw heads which are slidably removably received by and interlock with openings 111 and 112 formed in a plate 110 which is attached to the upper end of a plank 108 which downwardly extends from plank 101 and which preferably also rests on one or more horizontally oriented members 94.

As would be appreciated by those of skill in the art FIGS. 8 and 9 illustrate one structural configuration which, when assembly 90 is mounted on the upper plate (reference characters 26, 27), permits the elevation of member 94 to be adjusted with respect to fixed member 91. Other structural configurations can be readily devised which permit members 94 and 54 to slide up and down with respect to member 91. For example—instead of connecting the inner end of member 94 to members 95, 96, and 120—members 95, 96 and 120 can be eliminated and the inner end of member 94 provided with an opening which is comparable to opening 57 and can slide up and down along the exterior of member 91.

Having described the invention and presently preferred embodiments and the best modes thereof in such terms as to enable one of skill in the art to make and use the invention, we claim:

1. A method for a single individual to install a scaffold support assembly on an open stud wall, the wall including an inner side, an outer side, a plurality of vertically oriented studs each spaced apart a selected distance from an adjacent one of said studs and having an upper end, an outer edge on the outer side of the wall, and an inner edge on the inner side of the wall, a horizontally oriented plate extending between the upper ends of the studs and having an inside edge on the inner side of the wall and an outside edge on the outer side of the wall, the method comprising the steps of (a) providing a unitary scaffold assembly including (i) a first horizontally oriented elongate platform support member having a proximate end and a distal end, (ii) a second vertically oriented elongate rail supporting member having an upper end and a lower end connected to said distal end of said first member, (iii) a third vertically oriented elongate support member unit connected to said proximate end of said first member and extending upwardly and downwardly from said first support member, said third member including an upper end and a lower end, (iv) a fourth member connected to and extending outwardly from said upper end of said third member and shaped and dimensioned to slip from the inner side of the wall over the horizontally oriented plate;

(v) a fifth member rotatably mounted on said lower end of said third member below said first member and having a length greater than said selected distance, said fifth member movable between at least two operative positions, (vii) a first operative position generally coplanar with said first, second, third, and fourth members, and (viii) a second operative position generally perpendicular to said first, second, third, and fourth members;

said first, second, third, fourth and fifth members generally collectively lying in a common plane when said fifth member are in said first operative position;

(b) positioning said scaffold assembly on the inner side of the stud wall with said fifth member in said first operative position;

(c) moving said scaffold assembly between a selected adjacent pair of studs toward the outer side of the stud wall;

(d) positioning said scaffold assembly such that said fourth member engages and slides from the inner side of the stud wall over horizontally oriented plate, said fourth member extending over the inside edge of the horizontally oriented plate; and, (e) rotating said fifth member to said second operative position on the outer side of the wall and contacting the outside edges of the selected adjacent pair of studs.

2. A method for a single individual to install a scaffold support assembly on an open stud wall, the wall including an inner side, an outer side, a plurality of vertically oriented studs each spaced apart a selected distance from an adjacent one of said studs and having an upper end, an outer edge on the outer side of the wall, and an inner edge on the inner side of the wall, a horizontally oriented plate extending between the upper ends of the studs and having an inside edge on the inner side of the wall and an outside edge on the outer side of the wall, the method comprising the steps of (a) providing a unitary scaffold assembly including (i) a first horizontally oriented elongate platform support member having a proximate end and a distal end, (ii) a second vertically oriented elongate rail supporting member having an upper end and a lower end connected to said distal end of said first member, (iii) a third vertically oriented elongate support member unit connected to said proximate end of said first member and extending upwardly and downwardly from said first support member, said third member including an upper end and a lower end, (iv) a fourth member connected to and extending outwardly from said upper end of said third member and shaped and dimensioned to slip from the inner side of the wall over the horizontally oriented plate;

(v) a fifth member rotatably mounted on said lower end of said third member below said first member and having a length greater than said selected distance, said fifth member movable between at least two operative positions, (vii) a first operative position generally coplanar with said first, second, third, and fourth members, and (viii) a second operative position generally perpendicular to said first, second, third, and fourth members;

said first, second, third, fourth and fifth members generally collectively lying in a common plane when said fifth member are in said first operative position;

said first and second members slidably adjustable upwardly and downwardly with respect to said third member;

(b) positioning said scaffold assembly on the inner side of the stud wall with said fifth member in said first operative position;

(c) moving said scaffold assembly between a selected adjacent pair of studs toward the outer side of the stud wall;

(d) positioning said scaffold assembly such that said fourth member engages and slides from the inner side of the stud wall over horizontally oriented plate, said fourth member extending over the inside edge of the horizontally oriented plate;

(e) rotating said fifth member to said second operative position on the outer side of the wall and contacting the outside edges of the selected adjacent pair of studs; and, (f) slidably adjusting said first and second members upwardly with respect to said third member.

3. The method of claim 1 in which (a) said first and second members are slidably adjustable upwardly with respect to said third member; and, (b) after step (e), said first and second members and slidably adjusted upwardly with respect to said third member.

* * * * *